United States Patent [19]

Sato

[11] Patent Number: 4,545,424

[45] Date of Patent: Oct. 8, 1985

[54] METHOD OF CONTINUOUSLY CASTING STEEL

[75] Inventor: Takayuki Sato, Osaka, Japan

[73] Assignee: Satosen Co., Ltd., Osaka, Japan

[21] Appl. No.: 554,037

[22] Filed: Nov. 21, 1983

[30] Foreign Application Priority Data

Apr. 26, 1983 [JP] Japan ..... 58-74787

[51] Int. Cl.[4] ..... B22D 11/04

[52] U.S. Cl. ..... 164/491; 164/436

[58] Field of Search ..... 164/491, 436, 473

[56] References Cited

U.S. PATENT DOCUMENTS 3,736,977 6/1973 Stockinger ..... 164/491 X
3,941,182 3/1976 Bjorksten et al. ..... 164/473 X
4,299,266 11/1981 Hashio et al. ..... 164/491

FOREIGN PATENT DOCUMENTS 2841656 4/1980 Fed. Rep. of Germany ..... 164/436

*Primary Examiner*—Nicholas P. Godici
*Assistant Examiner*—Kenneth F. Berg
*Attorney, Agent, or Firm*—Armstrong, Nikaido, Marmelstein & Kubovcik

[57] ABSTRACT

This invention provides a method of continuously casting steel with the use of a copper or copper alloy mold comprising a pair of long side mold pieces and a pair of short side mold pieces slidable along the long side mold pieces for changing the width of the slab to be produced, the method being characterized by inserting into the mold at each corner thereof a cooling member made of a material identical or substantially identical with the steel to be cast and slidingly moving the short side mold pieces under reduced clamping pressure acting between the long side mold pieces and the short side mold pieces in contact therewith.

4 Claims, 5 Drawing Figures

METHOD OF CONTINUOUSLY CASTING STEEL

BACKGROUND OF THE INVENTION

This invention relates to a method of continuously casting steels, such as low-carbon steels, high-carbon steels, stainless steels and alloy steels, and more particularly to a method of casting slab by width changing technique during casting.

Conventional molds for continuously casting steels are generally made of copper or copper alloy having high thermal conductivity. It is considered critical to form a protective coating over the entire inner surface of the copper or copper alloy base body of the mold to be exposed to molten steel and solidified steel, thereby avoiding the direct contact of the steel with the copper or copper alloy base material. The mold is regarded as unserviceable when the protective coating has been worn away by casting operation to expose the copper or copper alloy base material to a certain extent.

Molds recently introduced into use for continuously casting slab comprise a pair of long side mold pieces (or broad face mold pieces) and a pair of short side mold pieces (or narrow face mold pieces) held therebetween. (The long side mold pieces and short side mold pieces will hereinafter be referred to as "long mold pieces" and "short mold pieces", respectively.) When required, the short mold pieces are slidingly moved longitudinally of the long mold pieces during casting operation to change the width of slab without interrupting the operation. With this technique, however, the sliding contact of the short mold pieces with the long mold pieces produces horizontal scratches in the inner surfaces of the long mold pieces to shorten the life of the mold. This will be described more specifically with reference to FIG. 1 which shows a mold comprising a pair of opposed long mold pieces 1 and a pair of short mold pieces 2 held therebetween. When the short mold pieces 2, as released from the mold clamping force, are slidingly moved toward or away from each other a distance of $l_1$ between the position defining the maximum width AD of the slab and the position defining the minimum width BC of the slab, extraneous solids (such as solidified steel fragments and solidified vitreous or like lubricant) biting in between the short mold pieces 2 and the long mold pieces 1 create horizontal scratches 3 as shown in FIG. 2. Such scratches occur especially markedly near the mold level. Since the width of the slab is changed considerably frequently in some production processes, the degree or depth of horizontal scratches is by no means negligible. For example, when the lateral movement of the short mold pieces for increasing the slab width creates deep horizontal scratches in the inner surfaces of the long mold pieces, the molten steel moving vertically will encounter increased resistance. Consequently it is even likely that the mold must be replaced in its entirety in a short period of use although flawless except the scratches.

To prevent horizontal scratching due to biting of extraneous solids, it has been proposed or practiced, for example, to ingeniously shape the opposite end faces of the short mold pieces, to supply an antifriction agent to the end faces or to cause the end faces to retain such agent. However, the mold pieces undergo deformation due to thermal strain, contraction, etc. when exposed to the heat of hot molten steel, and such deformation takes place markedly at the level of the molten steel, resulting in the likelihood that a clearance will be formed locally between the end face of the short mold piece and the long mold piece. Once such a clearance occurs in the vicinity of the level of the molten steel, the molten steel flowing in this region ingresses into the clearance and solidifies. When the short mold piece is moved with the solidified steel portion held between the end face of the short mold piece and the long mold piece, the solid steel portion scratches the inner mold side surface of the long mold piece as indicated at 3. To prevent the ingress of molten steel into the clearance, therefore, it has heretofore been necessary to clamp the short mold piece with high pressure and thereby minimize the clearance, but the high clamping pressure is likely to entail another fault such as damage to the mold.

INVENTION

Accordingly, an object of the present invention is to overcome the foregoing drawbacks of the prior art involved in changing the width of slab.

Another object of the invention is to provide a method by which when the width of slab is to be changed, the short mold pieces can be slidingly moved under greatly reduced clamping pressure acting between the long mold pieces and the short mold pieces in contact therewith.

Still another object of the invention is to provide a method of continuously casting steel without the likelihood of producing in the long mold pieces horizontal scratches which are inevitable in the prior art.

The present invention provides a method of continuously casting steel with use of a copper or copper alloy mold comprising a pair of long side mold pieces and a pair of short side mold pieces slidable along the long side mold pieces for changing the width of the slab to be produced, the method being characterized by inserting into the mold at each corner thereof a cooling member made of a material identical or substantially identical with the steel to be cast and slidingly moving the short side mold pieces under reduced clamping pressure acting between the long side mold pieces and the short side mold pieces in contact therewith.

I have carried out intensive research to eliminate the drawbacks of the prior art involved in changing the width of slab and found the following. When a cooling member of a material identical or substantially identical with the steel to be cast is inserted into the mold at each corner thereof, the cooling member rapidly cools the molten steel, vitreous powder and like molten substance to reduce the fluidity of such melt, physically block egress of the melt and promote formation of a shell (solidified skin) by cooperating with the mold in its intrinsic cooling function. More specifically, when the clamping pressure on the mold assembly of long and short pieces is reduced to change the width of slab, a clearance sometimes occurs between the end faces of the short mold pieces and the long mold pieces since the mold pieces are susceptible to deformation due to thermal strain or contraction as already stated. Consequently the molten steel tends to ingress into the clearance or escape through the clearance. However, when the cooling member of the present invention is inserted into the mold, the cooling member physically blocks the fluid melt in the vicinity of the level of the molten steel. Furthermore, the inserted cooling member, when melting by being exposed to the heat of the molten steel, rapidly cools the molten steel to lower the fluidity thereof, while the cooling member itself becomes more viscous, with the result that the molten steel can be prevented effectively from penetrating into the clearance and flowing out through the clearance. Inherently the molten steel is cooled by the mold from outside and forms a solidified skin which is termed shell, but in the vicinity of the level of the molten steel, the shell is extremely thin and is very susceptible to rupture due to an impact when the short mold piece is moved for a change of the slab width, consequently permitting the molten steel to flow out from the shell into the clearance and further escape from the mold. According to the invention, however, the cooling member, when inserted into each corner portion, assists the mold by cooling locally and also serves as a nucleus for forming the shell, contributing to the development of the shell at the corner portion near the level of the molten steel. The shell therefore becomes less susceptible to rupture even when the change of the slab width exerts an impact thereon, thus eliminating the likelihood of the molten metal penetrating into the clearance and escaping therethrough.

As a result, it is possible to greatly reduce the clamping pressure acting on the long mold pieces and the short mold pieces where they are in contact with each other. Whereas a high clamping pressure conventionally applied to minimize the above-mentioned clearance is liable to cause damage to the mold, this problem is avoidable by the use of the cooling member. Thus, should extraneous solids be caught in the clearance, they are least likely to horizontally scratch the long mold piece. This gives a prolonged life to the mold.

BRIEF DESCRIPTION OF THE DRAWINGS

The present invention will be described below with reference to the accompanying drawings illustrating the embodiments of the invention.

DETAILED DESCRIPTION OF THE INVENTION

Figure 1:
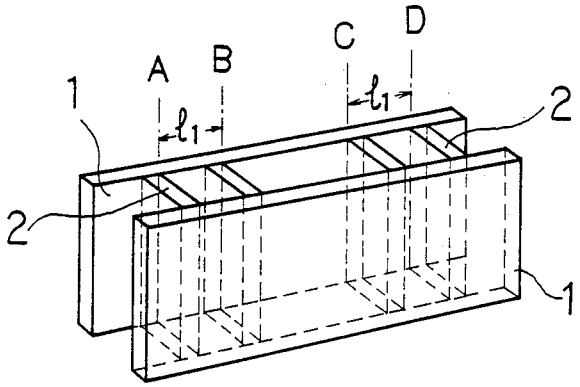
FIG. 1 PRIOR ART
FIG. 1 shows diagrammatically a conventional continuous casting mold.
Figure 2:
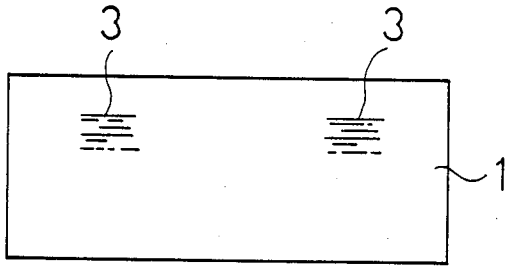
FIG. 2 PRIOR ART
FIG. 2 shows a side elevational view of a long mold piece inner side surface of the mold of FIG. 1.
Figure 3:
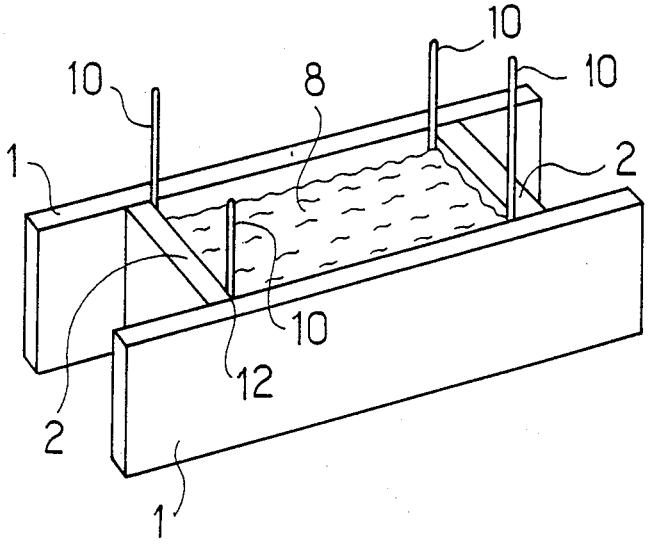
FIG. 3 is a diagram showing a method of changing the width of slab while inserting cooling members according to the invention into a mold comprising a pair of long side mold pieces 1 and a pair of short side mold pieces 2.

According to the present invention, the short mold pieces 2 are slidingly moved for changing the width of slab while inserting a cooling member 10 into the mold at each of its four corners as shown in FIG. 3. At this time, the cooling member 10 is inserted into the mold in intimate contact with the corner 12 where the end face of the short mold piece 2 is in contact with the long mold piece 1. The inserted cooling member 10 rapidly cools the molten steel, molten vitreous powder, and like molten substance in the vicinity of the cooling member to lower the fluidity of the melt or solidifies the same, preventing the melt from escaping through the clearance between the long mold piece 1 and the end face of the short mold piece.

The cooling member 10 is made of a material which is identical or substantially identical with the steel 8 to be cast. The cooling member 10 partially or completely melts when immersed in the molten steel and unites with the molten metal or with the surface of solidified steel. Use of the identical or substantially identical material eliminates the procedure for removing the cooling member from the cast steel and is therefore advantageous.

The cooling member 10 is not limited particularly in its cross sectional shape insofar as it is capable of rapidly cooling the neighboring molten metal and like melt when inserted in to result in reduced fluidity and block the melt. Thus the cooling member can be in any of various shapes. For example, the member can be in the form of a ribbon having a rectangular cross section, or it can be circular, elliptical, L-shaped or square in cross section. In view of ease of insertion, examples of useful cooling members are those having flexibility, such as a rod of circular cross section having a diameter of about 1 to about 3 mm, and a strand having a diameter of about 3 to about 10 mm and composed of thin wires twisted together.

Figure 4:
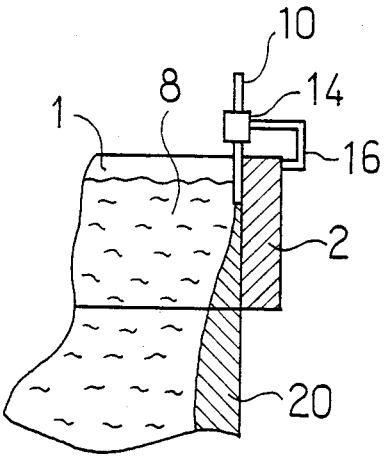
FIG. 4 is a fragmentary view in section taken along the vertical line near the edge of a short mold piece and showing the mold during continuous casting to illustrate the method of inserting the cooling member.

As seen in FIG. 4, the cooling member 10 is inserted into the mold with use of a holder 14 which is fixedly positioned immediately above the inside corner of the mold by a support 16 attached, for example, to the outer side of the short mold piece 2. Although various holders are usable, it is most preferable to use a holder which is periodically openable in timed relation with the vertical oscillation of the mold to insert the cooling member 10 at the same speed as the withdrawal of the slab.

The cooling member 10 may be of a predetermined length as shown in FIG. 4, such that when one member 10 has been consumed, another one is subsequently supplied. Alternatively as seen in FIG. 5, an indefinite length of cooling member 10 may be supplied to the holder 14 by way of rollers 18 for continuous insertion.

Figure 5:
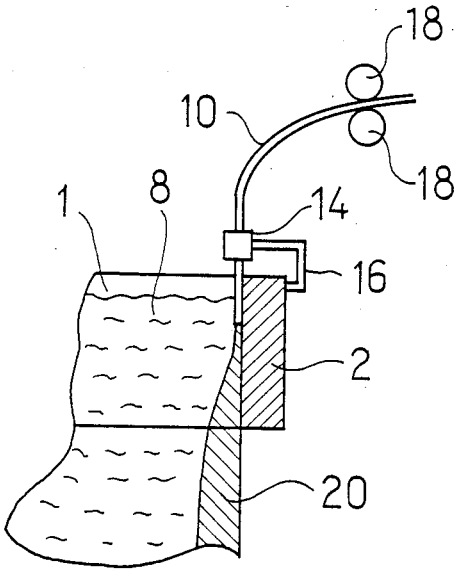
FIG. 5 is a fragmentary view in vertical section of a mold showing a modification of the embodiment illustrated in FIG. 4.

The cooling member 10 thus inserted into the mold along each corner thereof as shown in FIG. 4 or 5 physically blocks the molten steel 8 in the vicinity of the level of the molten steel at the corner portion without allowing the molten steel to escape through the clearance between the long mold piece 1 and the end face of the short mold piece 2 while rapidly cooling the molten steel at the corner portion close to the level to lower the fluidity thereof.

As the cooling member 10 is inserted into the mold from the midportion thereof further downward, the cooling member melts and fails to perform the foregoing function. By this time, however, the member has assisted the mold in its intrinsic cooling function to solidify the molten steel, also serving as a nucleus for forming a shell 20 to render the shell less susceptible to rupture against the impact to be exerted when the slab width is changed, therefore, there is little or no need to consider the problem of escape of the molten metal and like melt at the lower half portion of the mold.

As described above, the insertion of the cooling member 10 of the invention blocks the clearance against the penetration and escape of the molten steel, molten vitreous powder or the like at the corner portion close to the level of the molten steel, so that the pressure under which the short mold pieces 2 are clamped between the long mold pieces 1 can be decreased greatly. In the prior art, it is necessary to minimize the clearance between the long mold pieces and the short mold pieces when the short mold pieces are to be moved for changing the slab width. Thus even when a clearance occurs owing to the deformation or like of the mold in the vicinity of the level of the molten steel, the clearance must be reduced to about 0.2 to about 0.3 mm if largest. For example, when the clearance increases to about 0.5 mm, the molten steel, molten vitreous powder or like melt is very likely to flow out therethrough. Accordingly the short mold pieces must invariably be moved as clamped between the long mold pieces under very high pressure. This results in a great tendency that extraneous solids, if caught therebetween during the movement, create horizontal scratches on the long mold pieces.

In contrast, the present invention does not involve the likelihood that the melt at the corner portion close to the level of the molten steel will escape through a clearance even if it is as large as 1 to 2 mm. Thus, the pressure under which the short mold pieces are clamped between the long mold pieces can be much lower than in the prior art. This remarkably reduces the tendency for the long mold pieces to be scratched horizontally, should an extraneous matter be held between the contact portions, consequently giving a prolonged life to the mold.

I claim:

1. A method of continuously casting steel with use of a copper or copper alloy mold comprising a pair of long side mold pieces and a pair of short side mold pieces slidable along the long side mold pieces for changing the width of the slab while the slab is being produced, the method including continuously inserting into the mold only at each corner thereof, while the slab is being continuously cast, four continuous cooling members made of a material identical or substantially identical with the steel being cast and while continuously casting the slab and continuously inserting said continuous cooling members into each of said corners, slidingly moving the short side mold pieces clamped under reduced clamping pressure between said long side mold pieces relative to said long side mold pieces and thereby changing the width of the slab as the slab is being continuously cast.

2. A method as defined in claim 1 wherein the cooling member is inserted at the same speed as the speed at which the steel casting is withdrawn.

3. A method as defined in claim 1 wherein the cooling member is capable of rapidly cooling molten steel to thereby reduce the fluidity thereof at the corners of said mold and prevent the molten steel from ingressing into or escaping though the clearance between the long side mold pieces and the end faces of the short side mold pieces.

4. A method as defined in claim 1 wherein each cooling member is in the form of a ribbon having a rectangular cross section, a rod having a circular cross section or a strand.

* * * * *